United States Patent [19]

Kenner

[11] 3,957,071

[45] May 18, 1976

[54] CARRIER ATTACHMENT FOR INVALID WALKERS

[76] Inventor: M. Beatrice Kenner, 6300 Linway Terrace, McLean, Va. 22101

[22] Filed: Sept. 10, 1975

[21] Appl. No.: 612,037

[52] U.S. Cl. ..... 135/47; 108/115; 135/45 A

[51] Int. Cl.[2] ..... A45B 3/00

[58] Field of Search ..... 108/13, 14, 15, 25, 108/115, 124; 135/45 A, 47; 297/5, 6; 224/46 T

[56] References Cited

UNITED STATES PATENTS

| | | | |
|---|---|---|---|
| 2,430,235 | 11/1947 | Mendenhall | 135/45 A |
| 2,887,348 | 5/1959 | Sadowsky | 108/124 |
| 3,596,668 | 8/1971 | Tosto | 135/45 A |
| 3,625,237 | 12/1971 | Wertz | 135/45 A |

*Primary Examiner*—James T. McCall
*Assistant Examiner*—Darrell Marquette
*Attorney, Agent, or Firm*—William J. Daniel

[57] ABSTRACT

A carrier attachment including a rigid tray section and a pocket section is suspended by connecting straps from one side of the top frame member of an invalid walker. The tray section can be swung to operative position above and supported by the top frame member.

7 Claims, 6 Drawing Figures

CARRIER ATTACHMENT FOR INVALID WALKERS

INTRODUCTION

This invention relates to an attachment for invalid walkers and is concerned more particularly with a walker attachment designed to accommodate various articles and including a rigid supporting tray for the convenience of its user.

BACKGROUND AND OBJECTS

Invalid walkers are now a well-known aid for those who are aged, handicapped, injured or otherwise experience difficulty in walking normally and require some kind of stabilizing assistance. While these walkers may vary in structural details, they in general include a generally U-shaped top frame member, having a base section and two arm sections, which is supported more or less horizontally at a convenient height above the ground by four legs extending rigidly downwardly from the two corners and the ends of the two arm sections. Usually the legs are braced at one or more intermediate points along their length either by a similar U-frame or by individual bracing members extending between the two corner legs and between each corner leg and the corresponding end leg, leaving open the side between the end legs.

In use, the person requiring assistance positions himself in the open side of the U-shaped frame while grasping the adjacent arm sections, moves the walker a short distance forward and then makes a following step while placing weight upon the walker and being stabilized thereby against falling. Because of the fourpoint contact with the ground and the relatively wide disposition of its legs, the walker constitutes a stable supporting structure and is of valuable assistance to its user.

Implicit in the steadying effect of such walker is the requirement that it be grasped by both hands of the user. Even if sufficient support were received from only one hand, one would find it somewhat awkward to move a walker with only one hand because of its U-shaped construction, and because a two-handed grip is the natural way of manipulating such a structure. Necessarily then, both hands are occupied during use and the user is therefore severely limited in freedom and ability to carry the variety of articles, such as pocketbooks, purses, medical accessories and other paraphernalia that is customary or might be of assistance. While such articles could be carried in pockets provided in the wearer's garments or in bags suspended from the neck or shoulder, the result would be to add to the weight required to be supported by the already inadequate limbs of the user and make walking all the more difficult.

The object of the present invention is a carrier attachment which is suspended directly from the walker itself and is constructed in two sections including a rigid supporting traylike section for disposition along the top of the U-shaped frame and a hanging pocket or pouch section formed with one or more pockets for transporting the needed articles connected by suspension straps encircling a frame member of the walker.

BRIEF DESCRIPTION OF THE DRAWINGS

This and other objects will be more clearly described in the following detailed description when read in conjunction with the accompanying drawings in which.

DETAILED DESCRIPTION OF THE DRAWINGS

Figure 1:
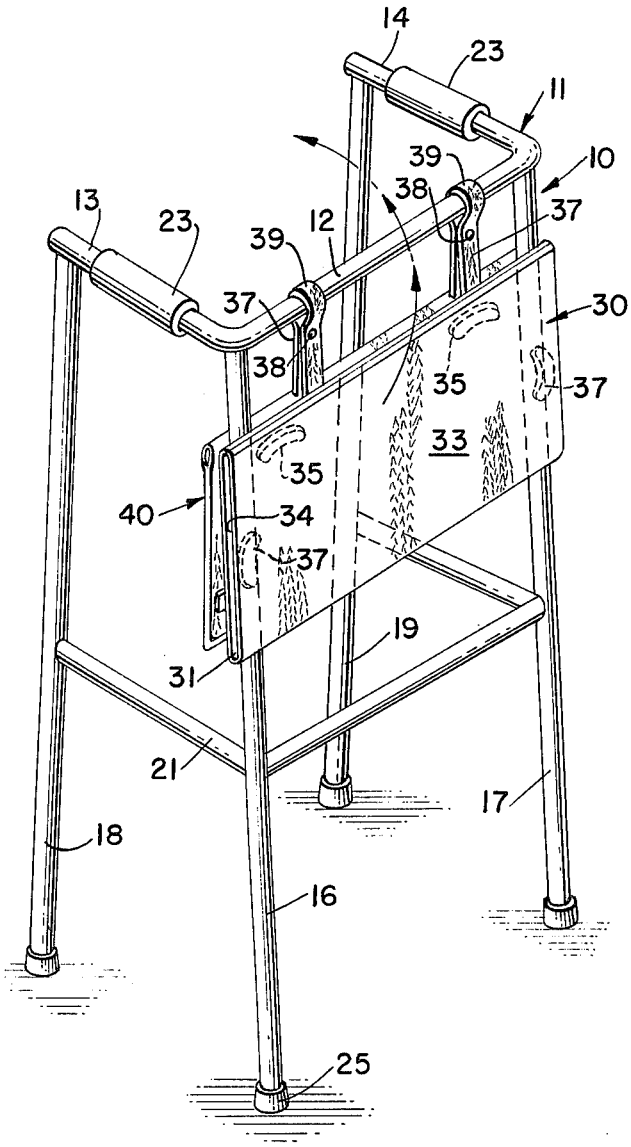
FIG. 1 is a perspective view from the front of an invalid walker equipped with the carrier attachment of the invention in the normal position that attachment would occupy when the walker is used for walking.

Referring now to the drawings, the numeral 10 generally designates the invalid walker itself which can be of any conventional design and, in this instance, includes the horizontally arranged generally U-shaped top frame member 11, having a base section 12 and opposed arm sections 13, 14 supported at a convenient height above the ground surface by legs 16 and 17 rigidly connected thereto at its respective corners and legs 18 and 19 rigidly connected adjacent its free ends. Preferably, the supporting legs 16–19 extend at a slightly outward inclination from the vertical in at least the forward-to-back direction, and ideally in the sidewise direction also, so as to afford maximum stability by reducing the center of gravity of the structure. Intermediate their ends, the supporting legs are braced together on the 3 sides corresponding to the upper U-shaped frame 11, as at 21. As is well known, these elements are ordinarily constructed of hollow tubes of lightweight metal, such as aluminum, in order to minimize weight. Cushioning handgrips can be provided on the arms of the upper U-shaped frame 11 as at 3 although these are not essential. Similarly, the lower ends of the tubes can be capped as at 25 by means of plastic or resilient caps to increase the friction with the ground surface and prevent slipping. Obviously, top frame member 11 could be formed of separate sections fastened together directly or through the legs, similar to braces 21, instead of as an integral unit.

Figure 4:
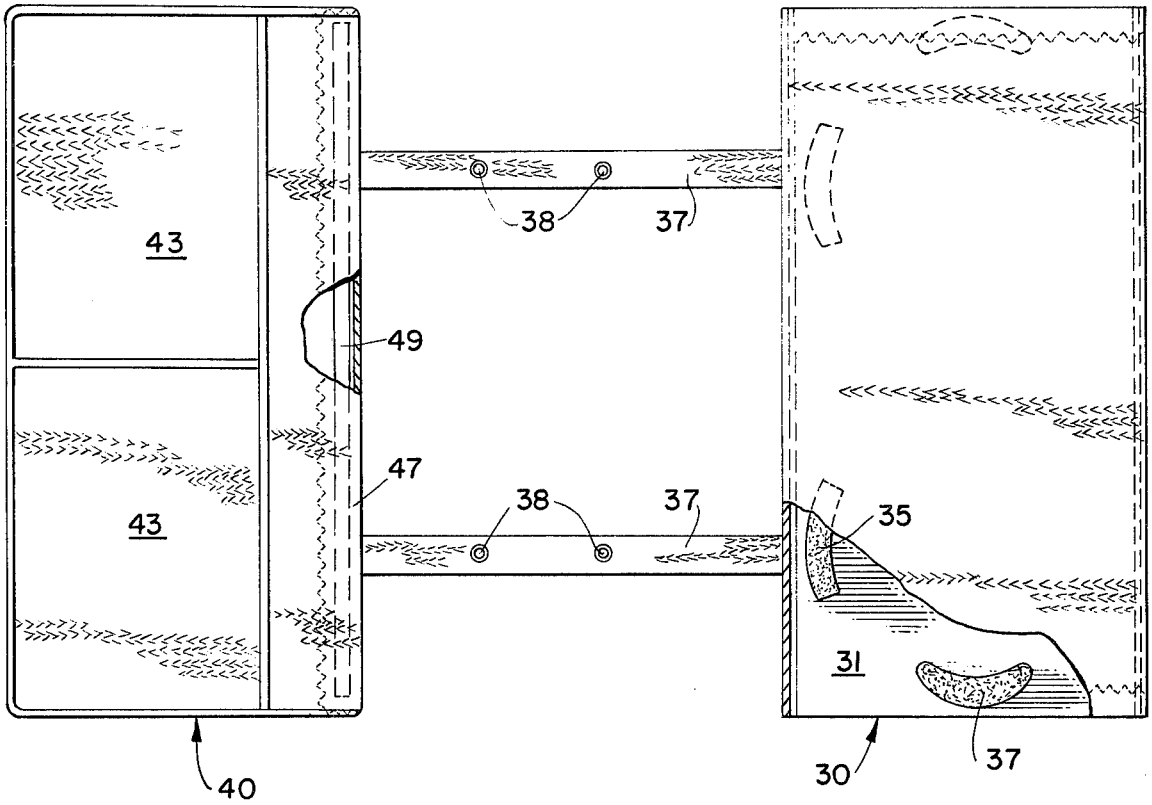
FIG. 4 is a plan view of the carrier attachment removed from the walker and arranged in extended flat condition.
Figure 5:
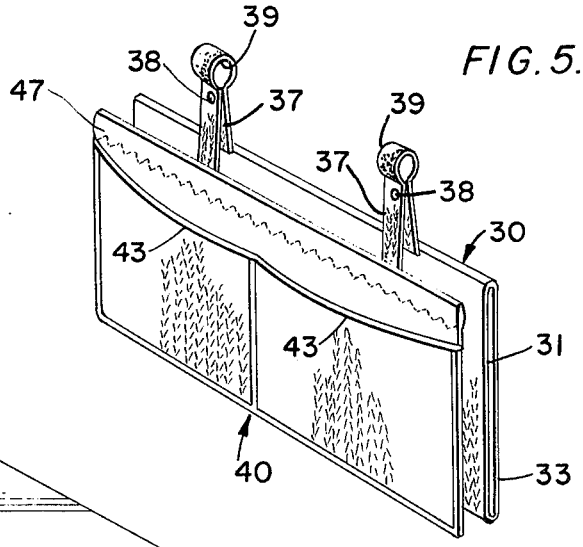
FIG. 5 is a perspective view of the attachment removed from the walker but otherwise in the operative position illustrated in FIG. 2 and viewed from the pocket side.
Figure 6:
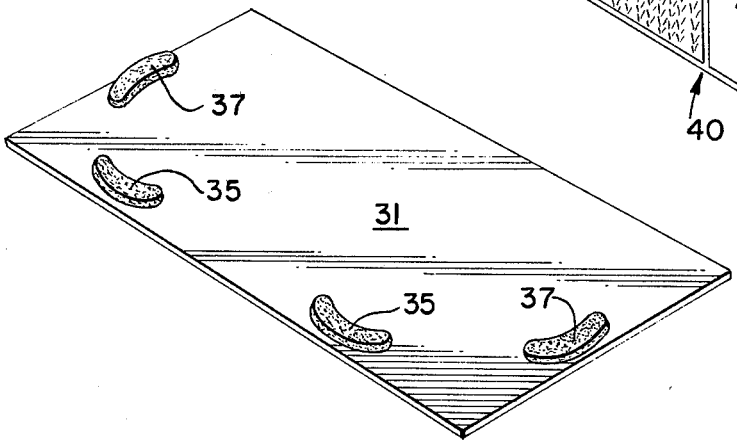
FIG. 6 is a detailed view showing a removable rigid traylike member separate from the remainder of the attachment.

The carrier attachment of the present invention includes a rigid traylike section generally designated 30 which in the illustrated embodiment takes the form of a separate rigid panel 31 (see FIGS. 4 and 5) of generally rectangular shape which is contained within a flat flexible sheath 33 of fabric or plastic film. The dimensions of the panel are such as to exceed at least slightly the distance between arm sections 13, 14 of frame member 11 so that panel 31 can be arranged along the top of member 11 to be supported thereby adjacent at least its two side edges and ideally its front edge as well (see FIGS. 2 and 3). Preferably the fabric sheath has at least one open end, as at 34, for ready removal of panel 31 to allow the sheath to be washed, since it may undergo soiling during use, or for storage purposes.

Figure 2:
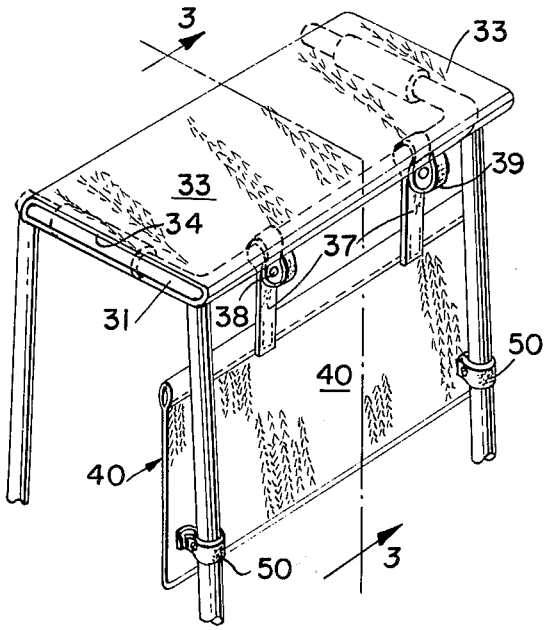
FIG. 2 is a fragmentary perspective view similar to FIG. 1 showing the rigid traylike section of the attachment in operative position along the top of the walker while the pocket section remains suspended therebeneath.
Figure 3:
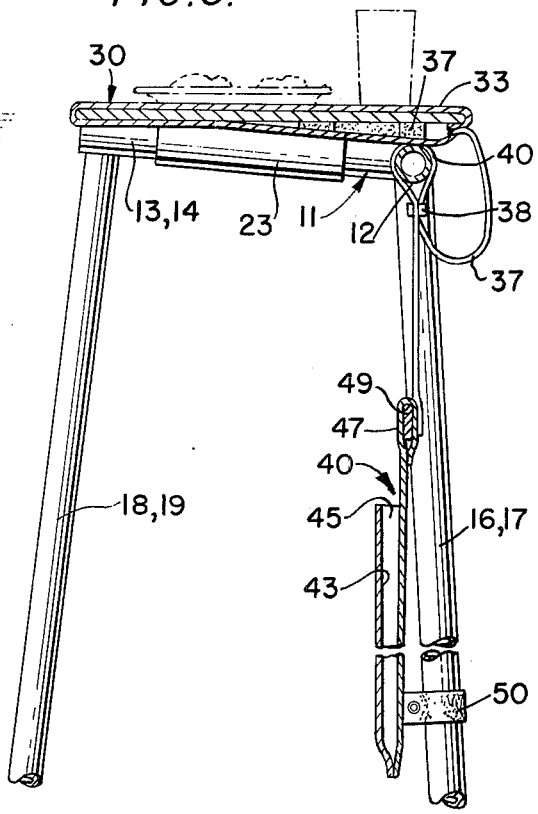
FIG. 3 is a partial vertical sectional view taken generally along line 3—3 of FIG. 2.

In the type of walker illustrated in the drawings, U-shaped upper frame member 11 has a slight forward and downward inclination (see FIG. 3) and to compensate for this declination, the panel 31 is provided adjacent its forward edge with spacer pads 35 of a thickness sufficient to raise the front end of tray section 30 to generally horizontal position when arranged on top of the walker as in FIGS. 2 and 3. These spacer pads may be formed from spongelike or other cushioning material. Preferably, similar pads 37 are provided adjacent the lateral edges of panel 31 to abut against the outer edges of the arms 13, 14 of U-shaped frame member 11 and thus hold the tray section 38 against accidental lateral movement relative to the walker. Since legs 16, 17 splay outwardly, pads 37 can be located in at least partial alignment therewith to cushion any impact between the tray panel and these legs and reduce noise. Alternatively, the pads 37 could be spaced inwardly from the side edges of the tray panel for engagement with the inside surface of the frame arms.

If the walker itself has its top frame member supported more nearly in a horizontal orientation, without the inclination shown in the drawings, the pads 35 nevertheless can perform a useful function since by slight adjustment of the tray position these pads can give an abutting contact with either the inside or the outside surface of the base section 12 of frame member 11 and in this way hold the tray panel against displacement in a further direction.

Attached to the fabric sheath 33 at spaced points along one of its side edges are the ends of two flexible supporting straps 37 which are of sufficient length as to extend over and around the base section 12 of frame member 11 and afford a reasonable working clearance between that frame member and tray section 30 of the attachment. These supporting straps 37 are equipped on either side below the portion 39 thereof which extends around the frame tube with fastener means 38 which when connected together define encircling loop-shaped portions holding the attachment in place on the walker. Fastener means 38 could be permanent in nature but are usefully made detachable to permit the attachment to be removed from the walker and can take the form of snap fasteners, button and buttonhole, velcro or other conventional fastening means.

The other ends of suspension straps 37 are connected to a pocket section of the attachment of the invention generally designated 40. The section 40 is formed on one side, which is desirably the inward facing side toward the open side of the walker, with one or more pockts 43 stitched in place with an open upper end, as at 45, as is illustrated particularly in FIGS. 3 and 5. Obviously, the number and shape of such pockets can be adjusted to fit individual preferences and any particular articles that the user may desire to have carried.

The pocket section 40 is likewise normally constructed of fabric or like flexible material and to hold the same in extended position, a tubular seam 47 is arranged along the upper side edge of pocket section 40 with a rigid spreader rod 49 inserted therein.

When the walker is in actual use for walking purposes, the carrier attachment would typically occupy the position indicated in FIG. 1 wherein the suspension loops are engaged on base section 12 of frame member 11 with the tray and pocket sections hanging downwardly therefrom on the outside and inside, respectively, of the front pair of legs 16, 17. In this position, pocket section 40 is more conveniently located for access by the user and to prevent this section from swinging inwardly into contact with the user's legs during walking, retainer straps 50 are provided adjacent the lower outer corners of the pocket section 40 (see FIG. 2) which encircles the adjacent vertical legs 16, 17, and hold the pocket section in place.

Alternatively, pocket section 40 could be arranged on the exterior side of the front legs 16, 17 with a slight loss in convenience because of reduced accessibility. In either case, the tray section 30 is situated on the exterior side of legs 16, 17 and, inasmuch as any swinging motion by this section would therefore be away from the user, no restraining straps would normally be required although such could be inclined if desired.

By virtue of the inclusion of the tray section in the present carrier, the assistance of the walker is extended beyond its function during walking alone since when the user is in a resting, i.e. sitting, position, at the completion of walking, the tray can be lifted over the base section 12 of frame member 11 and placed thereon in the position shown in FIGS. 2 and 3 to give a very useful supporting surface. This surface can then support food for eating purposes (as suggested by the broken line showing in FIG. 3), writing implements for correspondence, game boards for entertainment, etc.

It would be within the spirit of the present invention to attach the suspension straps 37 directly to a rigid panel, and eliminate fabric sheath 33, as might be desirable for sanitary purposes or where a direct hard smooth surface was preferred. The inclusionn of the fabric sheath, however, simplifies the construction of the carrier in eliminating the necessity for the panel to have a finished appearance. Similarly, the attachment could be arranged for suspension from an arm section of the top frame with the straps connected to end edges of the two sections.

Other alterations and variations will be suggested to the skilled worker in the art and will be within the spirit of this invention as defined by the following claims.

What is claimed is:

1. A carrier attachment for invalid walkers of the type including a U-shaped upper frame member having a bight portion and a pair of arms supported adjacent its corners and free ends by generally upstanding rigid legs, which attachment comprises spaced apart suspension straps encircling said U-shaped frame at spaced points therealong, a rigid traylike supporting means attached along one of its sides to one end of said suspension straps, said traylike means having a length sufficient to bridge the arms of said U-shaped frame, a pocket section attached to the other ends of said suspension straps and constructed with at least one pocket on the side thereof facing the interior of the walker, and fastener means on said suspension straps to define loops encircling said U-shaped frame.

2. The attachment of claim 1 wherein said straps encircle the bight portion of said upper frame member.

3. The attachment of claim 1 wherein said fastener means are detachable to permit said attachment to be affixed to and removed from said walker.

4. The attachment of claim 1 wherein said tray means includes a separable generally rectangular rigid panel and a flexible sheath enclosing said panel, said sheath being joined to one end of said suspension straps along one side edge thereof.

5. The attachment of claim 1 wherein said upper U-shaped frame member of said walker is arranged with a slight declination and said tray means includes spacer pad means along the edge adjacent said upper frame member to maintain said tray means generally horizontal when the tray means is disposed above said frame member.

6. The attachment of claim 5 wherein said tray means includes detent means adjacent its opposite ends for contacting engagement with the arms of the frame member to prevent relative endwise displacement therebetween.

7. The carrier attachment of claim 1 wherein said tray means is disposed on the exterior side of the front supporting legs of said walker and the pocket section is disposed on the interior side thereof, and said pocket section includes restraining straps adjacent each of its ends and encircling the contiguous supporting leg to restrain said pocket section against swinging movement.

* * * * *